US012104838B2

(12) United States Patent
Wagner

(10) Patent No.: US 12,104,838 B2
(45) Date of Patent: Oct. 1, 2024

(54) ICE CUBE TRAY

(71) Applicant: Stan Wagner, Lyndhurst, OH (US)

(72) Inventor: Stan Wagner, Lyndhurst, OH (US)

( * ) Notice: Subject to any disclaimer, the term of this patent is extended or adjusted under 35 U.S.C. 154(b) by 630 days.

(21) Appl. No.: 17/321,683

(22) Filed: May 17, 2021

(65) Prior Publication Data

US 2021/0364212 A1 Nov. 25, 2021

Related U.S. Application Data

(60) Provisional application No. 63/028,076, filed on May 21, 2020.

(51) Int. Cl.
*F25C 1/246* (2018.01)
*F25C 1/04* (2018.01)

(52) U.S. Cl.
CPC ..... *F25C 1/246* (2013.01); *F25C 1/04* (2013.01); *F25C 2400/06* (2013.01)

(58) Field of Classification Search
CPC ..... F25C 1/246; F25C 1/04; F25C 2400/06; F25C 1/243
See application file for complete search history.

(56) References Cited

U.S. PATENT DOCUMENTS 2,594,127 A * 4/1952 Collier ..... F25C 1/24 206/508
4,183,446 A * 1/1980 Davis ..... B65D 43/162 220/4.23
5,976,588 A * 11/1999 Vincent ..... B65D 75/327 249/176
9,869,503 B1 * 1/2018 Saeks ..... F25C 1/24

* cited by examiner

*Primary Examiner* — Alison L Hindenlang
*Assistant Examiner* — Keran V Nguyen

(57) ABSTRACT

An ice cube tray includes a base and a lid for covering an open top of the base. The open top provides access to compartments for making individual ice cubes. The lid includes ridges on its bottom surface that define holding areas. When the lid covers the open top, such that the holding areas are facing the compartments, and the tray is turned upside down, ice cubes are released from the compartments and fall into the holding areas on the lid. When the base is moved away from the lid, the ice cubes are each held in a respective holding area for grasping by a user. Any ice cubes remaining on the lid remain held in the holding areas. The base can then be placed back over the lid and the tray can be turned right-side up, which returns the remaining ice cubes to their original compartments.

19 Claims, 6 Drawing Sheets

ICE CUBE TRAY

CROSS REFERENCE TO RELATED APPLICATION

This application claims priority to U.S. Provisional Patent Application Ser. No. 63/028,076 filed May 21, 2020, which is expressly incorporated herein by reference.

BACKGROUND

Ice cube trays are used for making ice cubes in a freezer. The trays generally include various sized and shaped compartments that are filled with liquid water, which water is frozen therein to create ice cubes. The ice cubes are then removed from the individual compartments as desired for use in cooling, usually for cooling liquids. Conventional ice cube trays have an open top for filling the compartments with water. This open top also allow access to the individual ice cubes. However, removal of a desired number of ice cubes from the tray is often difficult, especially without also inadvertently also removing more than the desired number of ice cubes.

Often, a user inserts a fingernail as a wedge under an edge of an ice cube to remove the ice cube from the compartment. This process has to be repeated for each one of the desired number of ice cubes, and thus can be overly cumbersome and time consuming, and require a certain level of dexterity. Other times, the whole tray is shaken so as to dislodge an ice cube from its compartment. However, this shaking may dislodge more ice cubes than desired. When more ice cubes are dislodged from the tray than desired, the excess ice cubes have to be individually replaced in their respective compartments, which takes up an undesirable amount of time, effort, and concentration; or they are discarded, which is a waste of resources.

SUMMARY

An ice cube tray includes a base and a lid. The base is configured to make a plurality of individual ice cubes at the same time, and includes an open top providing access to a plurality of separate compartments in the base. The lid includes hollow holding areas at a bottom of the lid. The lid is movable with respect to the base between an opened position in which the open top of the base is exposed, and a closed position in which the open top of the base is covered by the lid and the bottom of the lid is facing the open top. Each holding area is defined by a bottom surface of the lid and ridges extending from the bottom surface. When the lid is in the close position and the open top of the base is facing down, each of the holding areas is aligned with a respective one of the compartments of the base so as to receive an ice cube falling out of the respective one of the compartments.

DETAILED DESCRIPTION

The present subject provides an ice cube tray that addresses drawbacks associated with conventional ice cube trays, and provides a solution for easily removing a desired number of ice cubes from the tray. The present ice cube tray does not require the cumbersome removal of individual ice cubes by using a fingernail as is done with conventional ice cube trays. The ice cube tray also does not require having to individually replace ice cubes in their respective compartments, or the discarding of unused ice cubes as is done when shaking conventional ice cube trays.

The present subject matter includes a tray for freezing a liquid to form individual pieces of frozen liquid. The liquid is not particularly limited and may include water, alcohol, juice, etc., but it should be understood that other liquids can be frozen in the tray. Merely for convenience and not to limit the present subject matter, the liquid will be referred to herein as water and the frozen liquid will be referred to herein as ice. The shapes of the individual pieces of frozen liquid are determined by the shape of the compartments in which they are made. The shapes of the compartments, and thus the shapes of the individual pieces of frozen liquid is not particularly limited and may include polyhedrons, prism with curved faces, cylinder, cones, spheroid, torus, etc., portions thereof with rounded or sharp edges/corners, or combinations thereof, but it should be understood that the compartments, and thus the individual pieces of frozen liquid can have other shapes as desired. Merely for convenience and not to limit the present subject matter, the individual pieces of frozen liquid will be referred to herein as cubes.

The ice cube tray includes a base and a lid for covering an open top of the base. The open top provides access to compartments in the base that are configured for making individual ice cubes. The lid includes ridges on its bottom surface that define holding areas. When the lid covers the open top, such that the holding areas are facing the compartments, and the tray is then turned upside down, ice cubes are released from the compartments and fall into the holding areas on the lid. When the base is moved away from the lid, the ice cubes are each held in a respective holding area for selecting by a user. Any ice cubes remaining on the lid remain held in the respective holding area. The base can then be placed back over the lid and the tray can be turned right-side up, which returns the remaining ice cubes to their original compartments.

Figure 1:
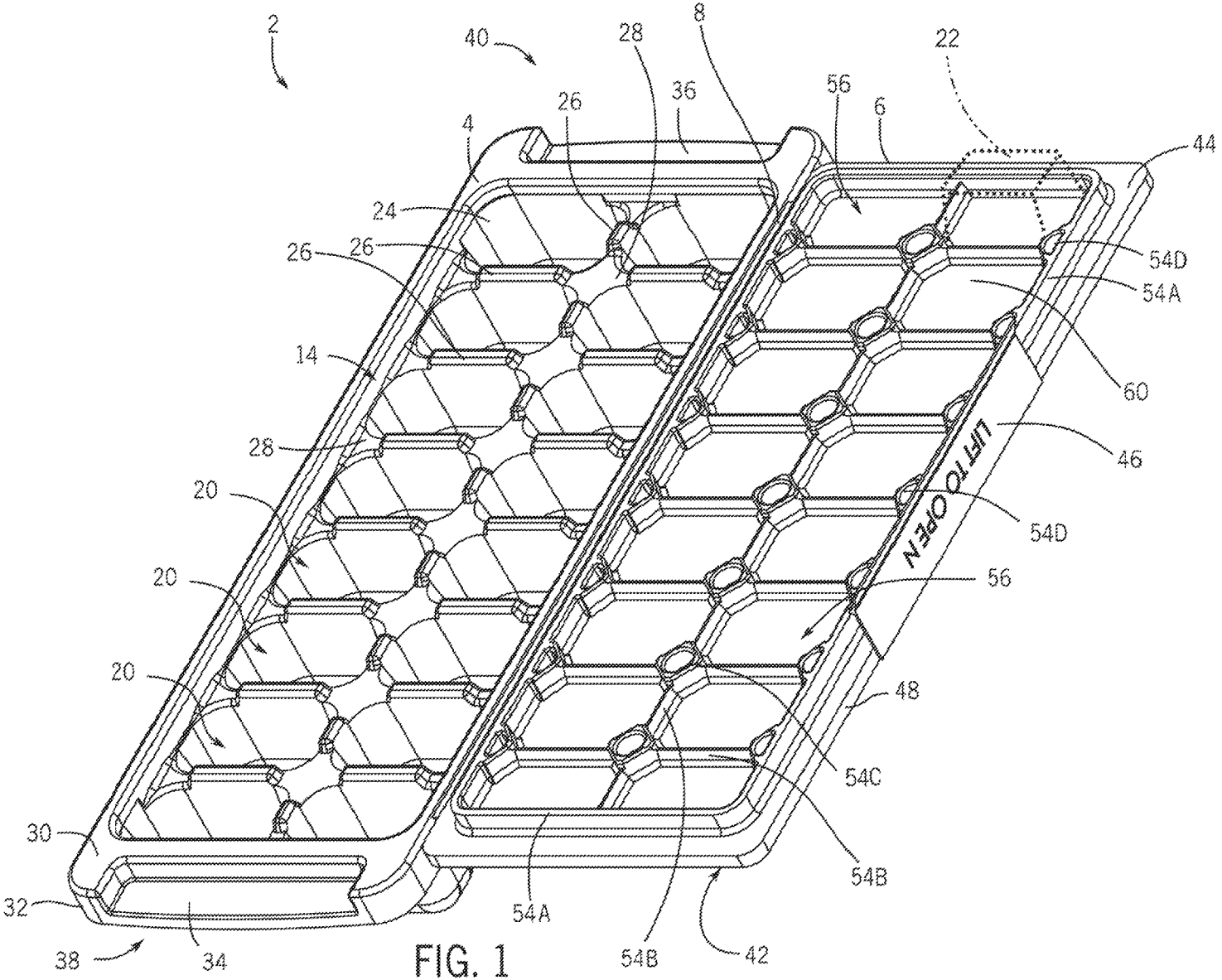
FIG. 1 is a perspective view of an ice cube tray according to the present subject matter.
Figure 2:
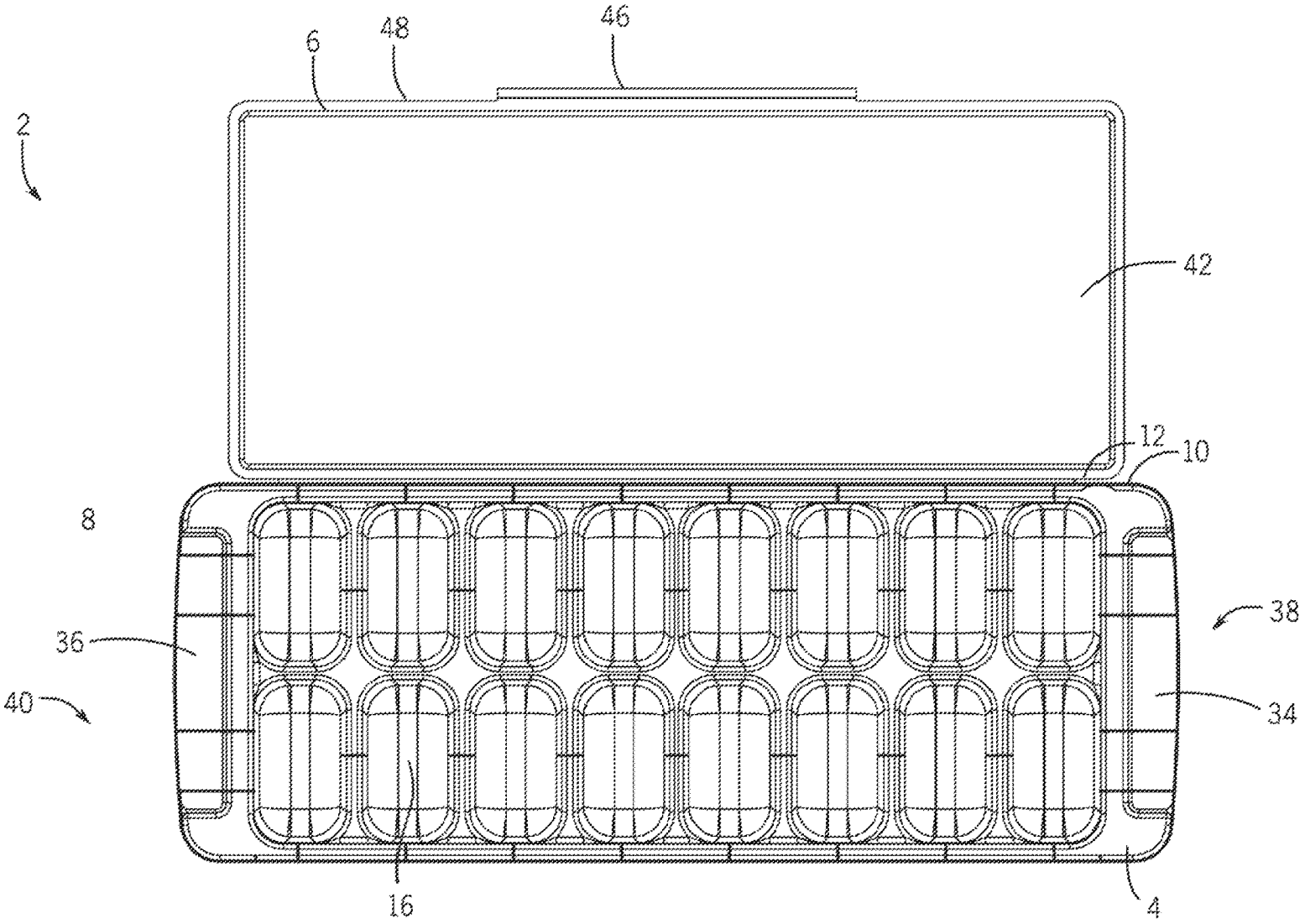
FIG. 2 is a bottom view of a base and a top view of a lid of the ice cube tray of FIG. 1.

Referring now to the figures, wherein the representations are for purposes of illustrating one or more embodiments only and not for purposes of limiting the same. FIG. 1 depicts an ice cube tray 2 including a base 4 and a lid 6 for covering the base for making ice cubes. The lid may be separate and distinct from the base, or may be connected to the base at a hinge 8. The hinge 8 may be arranged between a first edge 10 of the base and a corresponding second edge 12 of the lid. The base and lid are moveable with respect to each other. The lid may be moved between an opened position (e.g. FIGS. 1-7, 8B-C), where an open top 14 of the base is exposed, thus providing access to compartments 20 in the base, and a closed position (e.g. FIGS. 8A and 8D), where the lid covers the open top, thus closing off access to the compartments. When the lid is in the closed position, the tray is considered to be in a closed configuration. When the lid is in the opened position, the tray is considered to be in a opened configuration.

If the lid is connected to the base, the lid may be moved with respect to the base by rotating at the hinge between the opened position and the closed position. The base, lid, and hinge may be a one-piece component forming the tray. This one-piece construction of the tray, including the base, lid, and hinge, may be realized by forming the tray via injection molding or other one-piece production methods. However, this one-piece tray is not required, and one or more of the base, the lid, and the hinge may be separate and distinct from the other components, and thus these may collectively make up a multi-piece ice cube tray. If separate components are used, then they may be connected to form the multi-piece tray.

In a one-piece tray, the hinge may be formed from a thin gauge material so as to be flexible and allow relative movement between the base and lid, e.g. movement of the lid about the hinge. In a multi-piece tray, the hinge may be formed by interlocking hinge knuckles integrally formed on the base and lid. In another aspect of a multi-piece tray, the hinge is separate and distinct from the base and from the lid, and is attached to the base and lid with connectors. In a multi-piece tray, the hinge may not be included, such that the lid may fit over or snap on to the base, and the lid and base may be completely separated from each other during use to open the tray.

The base includes the open top, and a closed bottom 16 and sides 18 that collectively define the individual and separated compartments for making a plurality of individual pieces of frozen liquid 22 (e.g. ice cubes) at the same time. The compartments are each configured to contain and separate liquid (e.g. water) when the base is in an upright orientation, i.e. right-side up where the open top of the base is facing up. When the lid is in the opened position, water may be poured through the open top into the individual compartments of the base. When the lid is in the closed position, the lid covers the open top, and the compartments may not be accessible for being filled with water.

The individual compartments may be separated from each other by walls 24 of the base, which separate each compartment from the others and define the shape and volume of the compartments, and thus define the shape and volume of the ice cubes. The shapes of the compartments may include polyhedron, prism with curved faces, cylinder, cones, spheroid, torus, etc., portions thereof with rounded or sharp edges/corners, or combinations thereof. As depicted, the compartments are cuboid shaped with rounded edges/corners.

Tops of the walls may be arranged below the open top of the base, and may define lands 26 and grooves 28. The lands may be arranged above the grooves. The open top of the base may extend up from the closed bottom of the base by 1.40-1.60 inches. The walls of the base may extend up from the closed bottom of the base by 1.20-1.35 inches, which dimension defines the depth of the compartments. The compartments of the base are deeper than the holding areas of the lid.

The base may include any number of individual compartments, such as for example, two rows of eight for a total of sixteen compartments as shown in the figures. However, this is not necessary, and the base may include more or less than shown in the figures. The compartments may all have the same or similar size and shape as shown in the figures. However, this is not required, and the compartments may have various sizes and shapes, which can be the same or different among the plurality of compartments. As shown, the compartments are generally hollow cuboid shaped with one open side (i.e. with an open top), are sixteen in number, and are aligned in two columns of eight.

The base may include a rim 30 extending horizontally out from the open top and defining the open top, and a skirt 32 extending down from the perimeter of the rim. Depressions 34, 36 may be formed in the rim and skirt at two respective ends 38, 40 of the base to thereby define handles for a user to grab and manipulate the base.

The lid generally defines a top 42 and an oppositely directed bottom 44 including a generally planar bottom surface 60. The lid is configured to move relative to the base, e.g. rotate at the hinge, and engage the base in the closed position such that the bottom surface of the lid faces the base and the lid covers the open top. The rim of the base and the bottom surface of the lid may contact each other when the lid is in the closed position.

Figure 3:
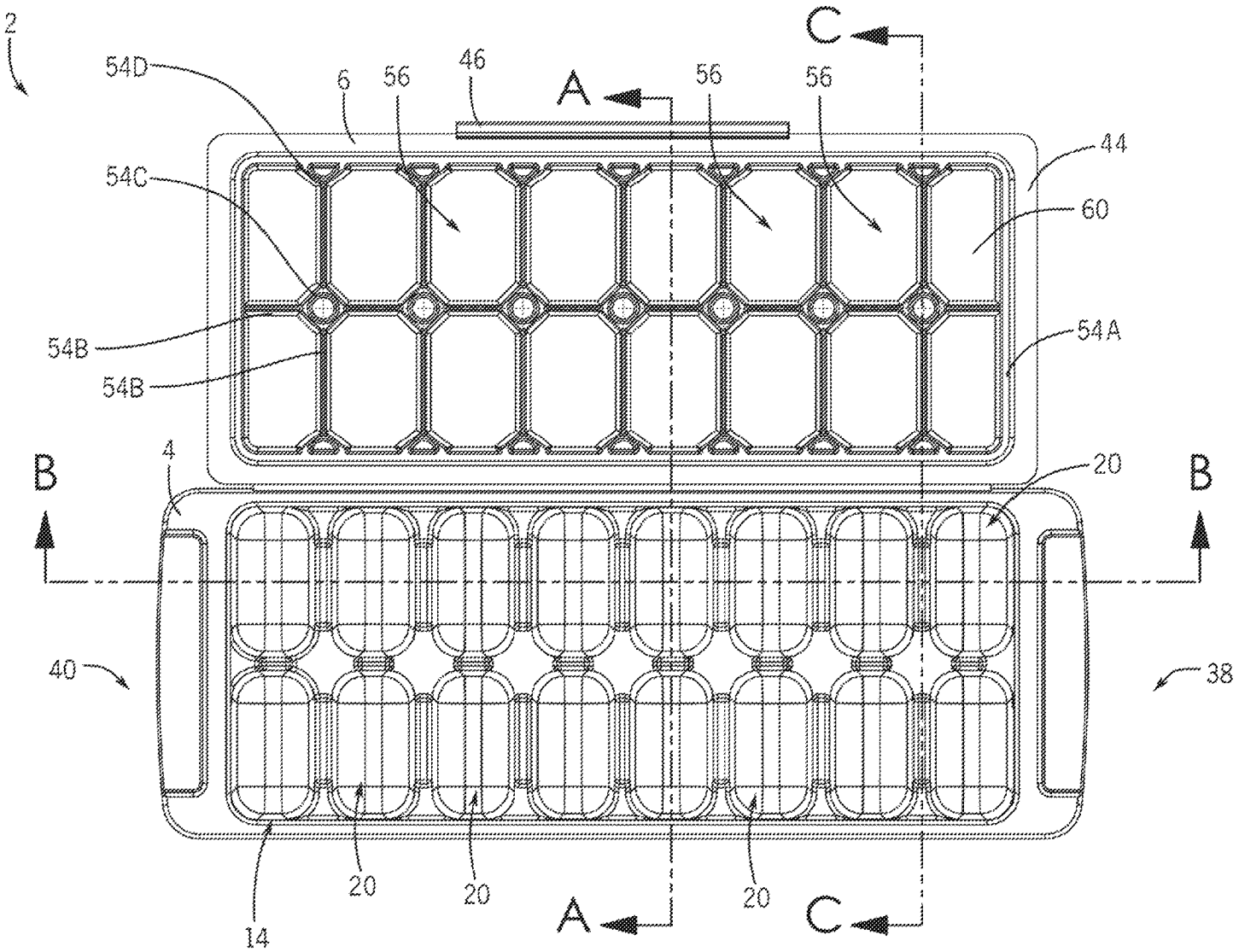
FIG. 3 is a top view of the base and a bottom view of the lid of the ice cube tray of FIG. 1.
Figure 4:
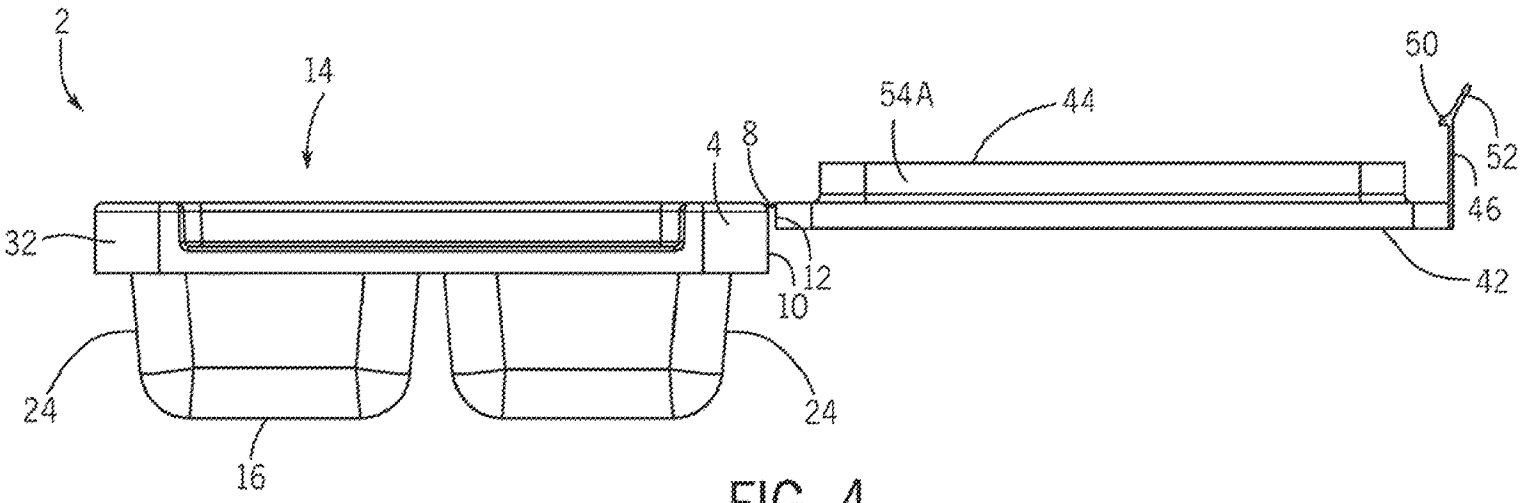
FIG. 4 is a side view of the ice cube tray of FIG. 1.
Figure 5:
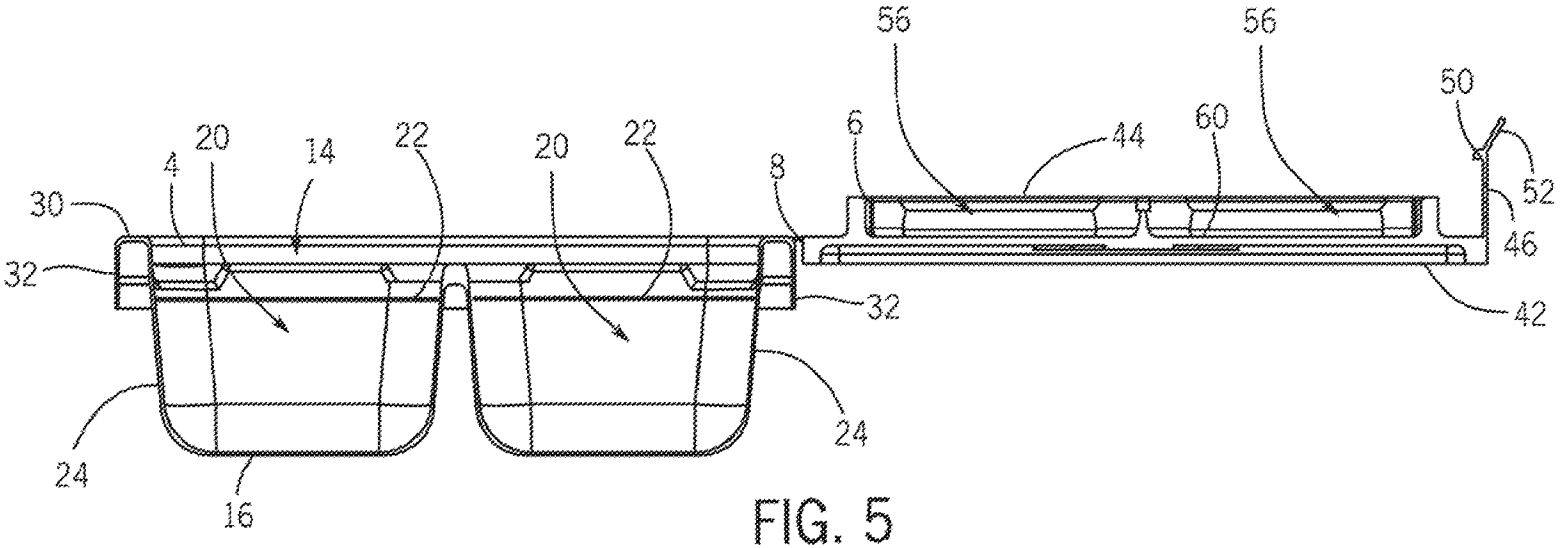
FIG. 5 is a cross sectional view taken along line A-A of FIG. 3.
Figure 6:
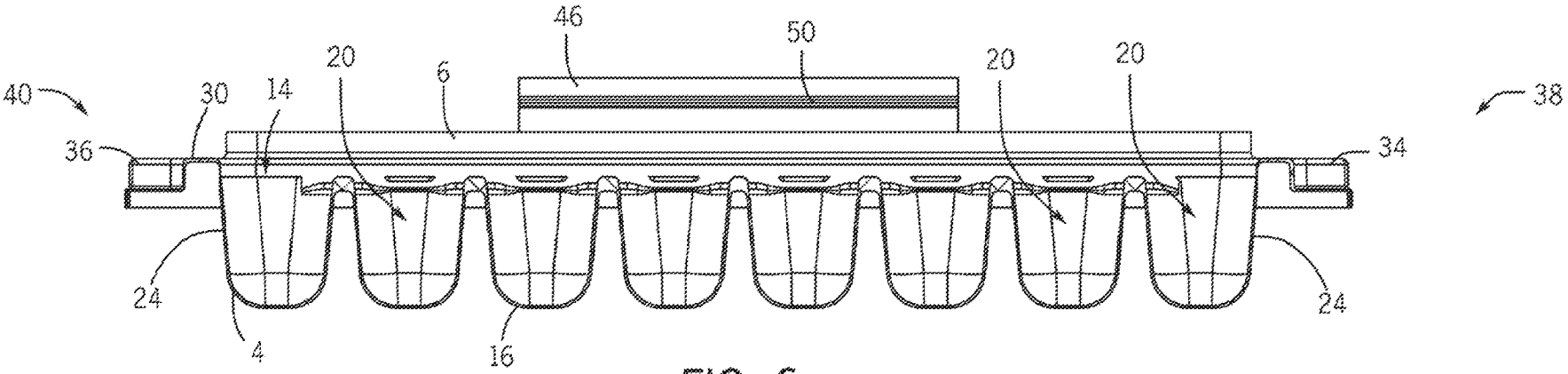
FIG. 6 is a cross sectional view taken along line B-B of FIG. 3.
Figure 7:
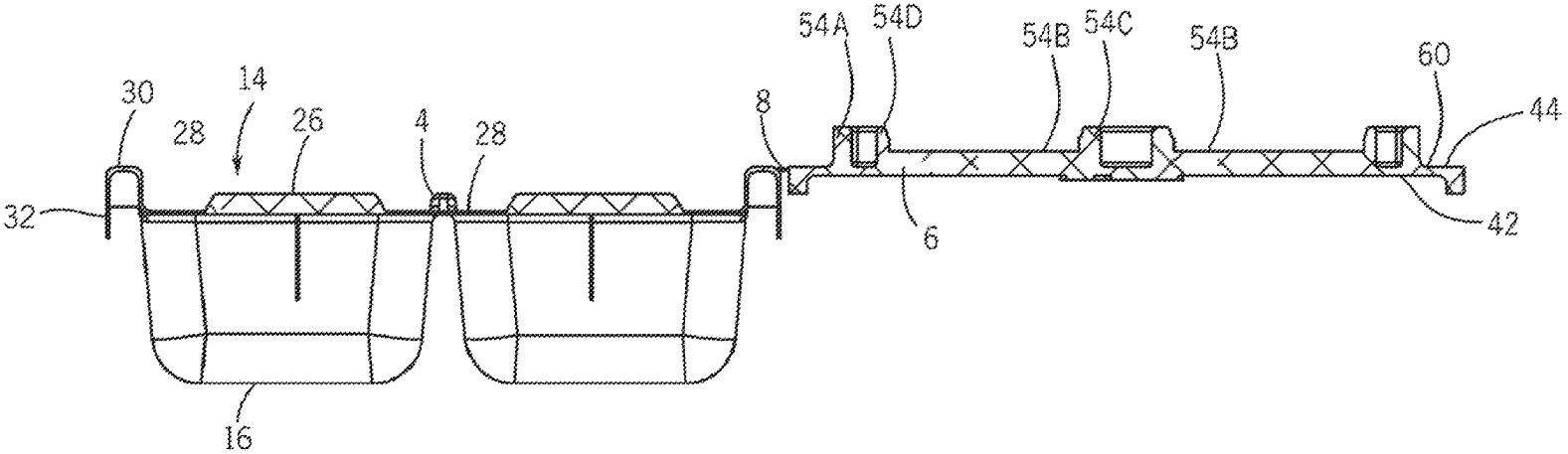
FIG. 7 is a cross sectional view taken along line C-C of FIG. 3.

In the opened position as shown in FIGS. 1, 3, and 4 for example, the lid does not cover the open top of the base, and thus the open top is exposed such that the compartments are accessible for being filled with water. In the opened position, the bottom of the lid and the open top of the base may generally face in the same direction, e.g. up.

The lid may include a latch 46 arranged at a third edge 48 of the lid opposite from the second edge 12 including the hinge, and is configured to lock the lid in the closed position. The latch may be rigidly connected to the lid, or moveably hinged to the lid. The latch may be part of the one-piece tray.

The latch may include a projection 50 for engaging the skirt when the lid is in the closed position so as to lock the lid in the closed position. The projection may slide over an outside of the skirt during movement of the lid toward the closed position, and then hook under the skirt when the lid is in the closed position to thereby lock the lid in the closed position. The latch may further include a lever 52 that can be pulled out by a user to cause the projection to be pulled out from under the skirt and thus release the lid from the closed position and allow the lid to be moved toward the opened position. The latch and lid may be a one-piece construction, or the latch may be separate and distinct from the lid but be connected to the lid. The latch may or may not extend the full distance along the second edge of the lid.

The bottom of the lid includes hollow troughs 56, which are also referred to herein as concave holding areas 56. The holding areas are defined by ridges 54 extending down from the bottom surface of the lid. The holding areas 56 correspond to the compartments in the base in one or more of shape, number, and arrangement, and are thereby configured to receive ice cubes 58 that are released from the compartments and hold the ice cubes in place on the lid (FIG. 1).

The holding areas are shown to each be shaped like a shallow hollow cuboid with one open side, are sixteen in number, and aligned in two columns of eight, and thus correspond to the shape, number, and alignment of the depicted compartments in the base for receiving ice cubes therefrom. However, these particular configurations for the compartments and holding areas are not required so long as their configurations correspond to one another. That is, the compartments can be of any shape, number, arrangement, and configuration as desired for making individual pieces of ice, so long as the holding areas on the lid have a corresponding arrangement, shape, number, and configuration as the compartments so as to be able to receive and hold in place on the lid the individual pieces of ice that are made in the compartments, dislodged from the compartments, and are placed in the holding areas.

The lid may include an outer ridge 54A and inner ridge, with the outer ridge surrounding the inner ridges. The inner ridges may include straight ridges 54B, circular ridges 54C with one at each intersection of four of the straight ridges, and triangular ridges 54D with one at each intersection of one of the straight ridges with the outer ridge. The inner ridges may be arranged in a grid as shown. The ridges divide the bottom of the lid into the individual holding areas. The holding areas may each be completely surrounded by the ridges as shown, or the holding areas may be only partially surrounded by the ridges. The ridges inhibit an ice cube from moving from the holding area, e.g. from sliding off of the lid.

The depth of the holding areas is defined by the distance that the ridges extend from the bottom surface of the lid, which may be 0.15-0.30 inches. The holding areas are not as deep as the compartments, which may have a depth of 1.20-1.35 inches. This is depicted in FIGS. 1, 8B, and 8C, which show the holding areas being not as deep as the compartments.

Figure 8A:
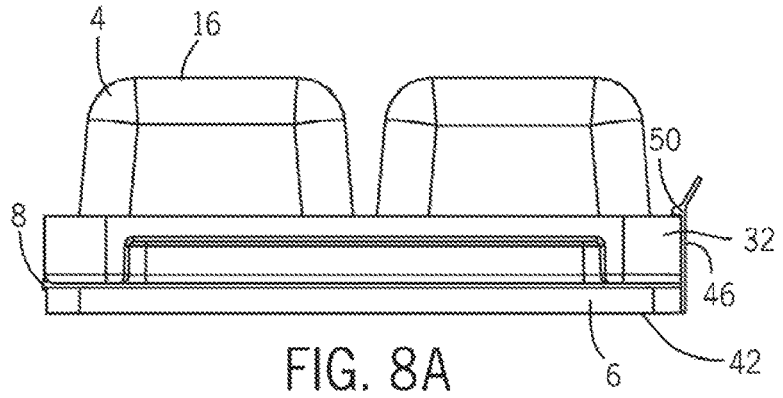
FIGS. 8A-8D are side views of a method of removing ice cubes from an ice cube tray according to the present subject matter.
Figure 8B:
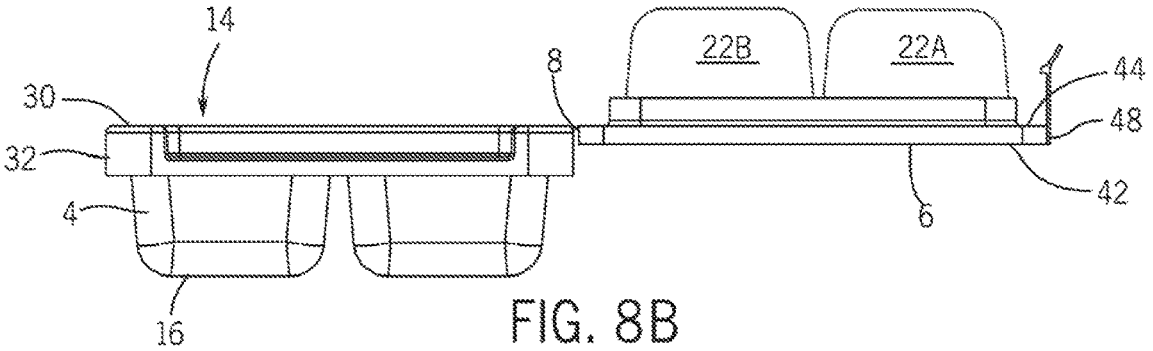
Figure 8C:
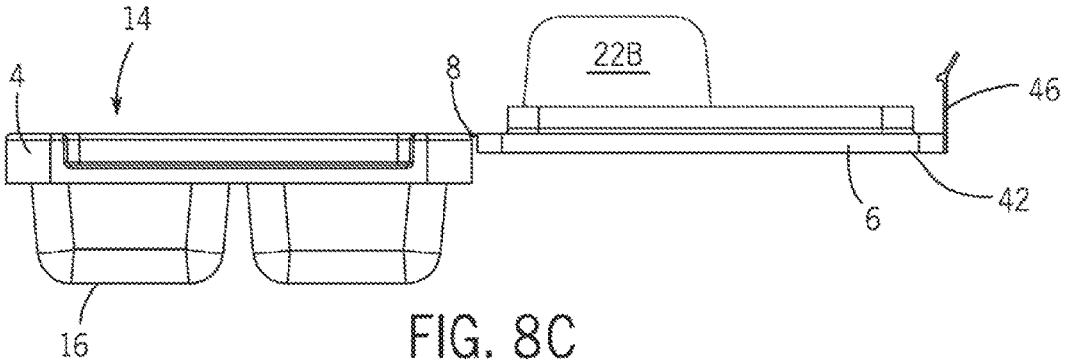

The holding areas may not be as deep as the height of the ice cubes, and thus when an ice cube is arranged in the holding area as shown in FIGS. 1, 8B, and 8C, thus the ice cube stick out from the holding area above the height of the ridges. As such, when the ice cubes are arranged in the holding areas, a portion of the ice cubes, e.g. a majority of the ice cubes, sticks out above the top of the ridges, and generally the holding areas each engage only a small portion of each of the ice cubes that is arranged inside the holding area so as to hold the ice cube on the lid.

The outer ridge may be continuous around the perimeter of the lid, and may be configured to fit inside the open top of the base when the lid is in the closed position. As shown, the tops of the walls of the base may be lower than the rim of the base. This may allow the outer ridge of the lid to be arranged within the open top when the lid is in the closed position. The perimeter of the outer ridge may correspond closely to the perimeter of the open top, such that the outer ridge mates with, and optionally fits snugly in, the open top when the lid is in the closed position. This may provide a snug form fit between the lid and the base, and may even be a mechanism for sealing the open top of the base to prevent liquid from escaping from the base.

The outer ridge may thus cooperate with the rim/open top to align each of the holding areas with a respective one of the compartments when the lid is in the closed position. In other words, when the tray is arranged upside down and the lid is in the closed position (FIG. 8A) such that the open top of the base is facing down and the bottom surface of the lid is facing up, each holding area is aligned with (e.g. directly below) a respective compartment, such an ice cube may fall from the respective compartment into the corresponding holding area, such that the ice cube may be in contact with the bottom surface of the lid and is held by the surrounding ridges in the holding area. This allows the ice cubes to be held on the lid even when the base is removed from the lid (FIG. 8B). With respect to the holding area being "aligned with" the respective compartment, this means that when the lid is in the closed position and the tray is upside down (FIG. 8A), an ice cube in the respective compartment can fall into, and thus be received by, the holding area. This aligned configuration between the compartments and the corresponding holding areas is maintained, no matter the orientation of the tray, so long as the lid is in the closed position, even in the right-side up orientation shown in FIG. 8D. This aligned configuration may include the center point of each of the holding areas being directly below the center point of the respective compartment.

The inner ridges may be arranged to correspond in position and arrangement with the walls of the base, and may thus be aligned directly over the walls when the lid is in the closed position. The outer ridge, circular ridges, and triangular ridges may extend further down from the bottom surface of the lid than the inner ridges. The outer ridge, circular ridges, and triangular ridges may extend 0.25-0.30 inches down from the bottom surface of the lid, while the inner ridges may extend 0.15-0.20 inches down from the bottom surface of the lid. These extension dimensions of the ridges from the bottom surface define the depth of the holding areas. The ridges may have a thickness of 0.10-0.15 inches. When the lid is in the closed position, the outer ridge, circular ridges, and triangular ridges may thus contact the grooves of the walls while the inner ridges may contact the lands of the walls. Contact of the ridges with and the lands and grooves is not required however, and the ridges may not contact the lands and/or grooves when the lid is in the closed position.

In use, water or other liquid is arranged in the compartments of the base so as to at least partially fill the compartments with water. Filing the compartments with water may occur when the lid is in the opened position (FIGS. 1-7) thus exposing the open top and providing access to the compartments. Once the compartments are filled with water, the tray may be placed in a freezer or other cool place in order to freeze the water in the compartments to form individual pieces of frozen liquid (ice cubes) in the compartments. Freezing of the water in the compartments forms ice cubes, which have a shape and size that are defined by the compartments.

Figure 8D:
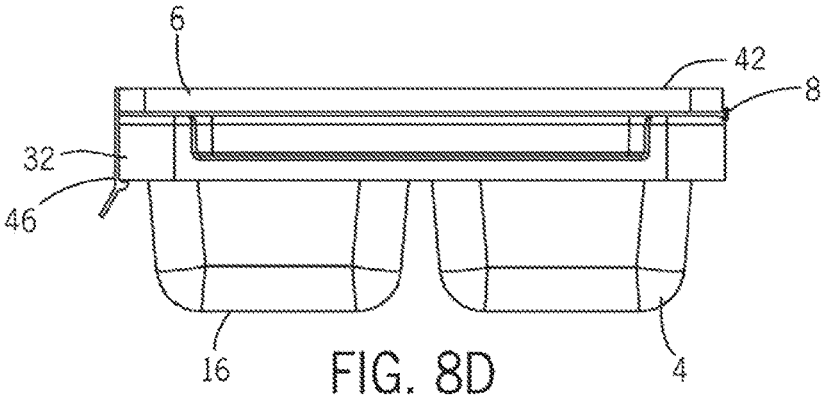

Before or after freezing, the lid may be moved, e.g. rotated about the hinge, from the opened position to the closed position such that the lid is placed over the open top of the base and covers over the open top (FIG. 8D). When the lid is not connected with the base, such as when the tray is not a one-piece tray, the lid may be left out of the freezer and separate from the base during formation of the ice cubes. In any event, no water is arranged in the holding areas of the lid during freezing, and thus no ice is formed in the holding areas of the lid. Thus, the holding areas of the lid do not define the shape and size of the ice cubes, as the water and ice formed during freezing do not contact the lid or holding areas during formation of the ice.

Once the ice cubes are formed, the tray may be removed from the freezer and bent or otherwise manipulated by a user so as to dislodge the ice cubes from their respective compartments. If the lid is not covering the open top of the base, such as if the lid and base are not integrally connected, then at this point the lid can be place over the base so that the lid is in the closed position and covering the open top.

Thereafter, the tray is turned upside down while the tray is in the closed configuration (FIG. 8A), and optionally placed on a surface such as a counter or table. In the closed configuration, the base is now over the lid, the open top of the base is facing down, and the bottom surface of the lid is facing up. Turning over the tray in this manner causes all of the dislodged ice cubes to fall from the compartments onto the bottom surface of the lid and into respective holding areas on the bottom of the lid. The base may then be removed from being over the lid, for example by rotation about the hinge from FIG. 8A to FIG. 8B, to thereby expose the dislodged ice cubes 58 being held on the lid (FIGS. 1 and 8B). Because the bottom surface of the lid is generally planar and flat, the ice cubes would normally be free to move around and even fall off the lid if the ridges were not present. However, because the ridges extend from the bottom surface to create the holding areas, the ice cubes are held by the ridges in their respective holding areas and thus do not slide or fall out of the holding areas or off the lid. As seen in FIGS. 1, 8B and 8C, the ice cubes extend from the bottom surface of the lid a greater distance than the ridges extend up from the bottom surface. This provides a top portion of each ice cube to be exposed above the ridges, and thus allows a user to easily grasp the ice cubes without interference from the ridges. However, because the ridges extend a short distance from the bottom surface of the lid, the ridges box in the ice cubes into the respective holding area and inhibit the ice cubes from moving out of their respective holding area.

A desired number of the ice cubes, for example ice cube 58A, may then be easily removed by a user from the lid by hand, while the remaining ice cube(s), for example ice cube 58B, that are not needed by the user are left on the lid in their respective holding area (FIG. 8C). In this way, a user does not have to remove individual ice cubes from their respective compartments using a finger nail as is conventional, and a user also does not have to shake the tray to remove the dislodge ice cubes from their respective compartments, which shaking may result in an indeterminate number of dislodged ice cubes being removed from their respective compartments. Instead, the present subject matter allows a user to easily grab a dislodged ice cube that has already been removed from its respective compartment while it is being held in its respective holding area on the lid.

After the desired number of ice cubes are removed from the lid, the base is moved back over the lid (FIG. 8A), for example by rotation about the hinge, and back over the remaining ice cubes (e.g. ice cube 58B) such that the remaining ice cubes are fit back into their original compartments from which they were previously dislodged and removed, and the base now again covers the remaining ice cubes. Fitting the remaining ice cubes back into their original compartments is possible because the ridges on the lid hold the remaining ice cubes in a position of alignment with their original compartments. In other words, the remaining ice cubes do not freely slide all over the bottom surface of the lid or even off of the lid, but instead are held in the place where they were deposited, i.e. in their respective holding areas under their original compartments. As such, when the base is moved back over the lid (as shown going from FIG. 8C to FIG. 8A), the ice cubes remaining on the lid are fit back into their original compartments. In this way, the base then covers over the remaining ice cubes and the tray is again in the closed configuration (FIG. 8A). While in this closed configuration, the entire tray may be flipped back over so that the tray is right side up again and still in the closed configuration (FIG. 8D), which will cause the remaining ice cubes to fall off of the lid and back into their original compartments.

By using the ice cube tray in this manner, ice cubes do not have to be individually removed from their respective compartments using a fingernail or otherwise, nor do an indeterminate number of ice cubes have to be removed from their respective compartments by shaking the entire tray and then individually returned to their respective compartments by hand or be discarded. Instead, only the desired number of cubes are removed from the lid, and any unused ice cubes are automatically returned to their original compartment by simply moving the base to cover over the lid and turning the entire tray right-side up. In this way, any unused ice cubes that have not been removed from the lid are easily returned to the original compartments.

As such, the present ice cube tray offers a quick and an environmentally friendly alternative to conventional ice cube trays because it does not require discarding of unused ice cubes. The tray offers a simple way to remove ice cubes from the base and replace ice cubes in the base, which saves effort and time expended by a user.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An ice cube tray comprising:

a base configured to make a plurality of individual ice cubes at the same time, the base including a rim surrounding an open top, the open top providing access to a plurality of separate compartments in the base;

a lid including hollow holding areas at a bottom of the lid, the lid being movable with respect to the base between an opened position in which the open top of the base is exposed, and a closed position in which the open top of the base is covered by the lid and the bottom of the lid is facing the open top, wherein each holding area is defined by a bottom surface of the lid and ridges extending from the bottom surface, wherein, when the lid is in the close position and the open top of the base is facing down, each of the holding areas is aligned with a respective one of the compartments of the base so as to receive an ice cube falling out of the respective one of the compartments, and wherein, when the lid is in the closed position, the ridges of the lid are arranged inside the base.

2. The tray according to claim 1, wherein the lid is connected to the base and the tray is a one-piece tray.

3. The tray according to claim 1, further including a hinge connecting the lid to the base.

4. The tray according to claim 1, wherein the bottom surface of the lid is planar.

5. The tray according to claim 1, wherein:

the rim extends horizontally out from the open top; and the base includes a skirt extending down from a perimeter of the rim.

6. The tray according to claim 5, wherein:

the lid includes a latch arranged on a side of the lid opposite from the hinge, and when the lid is in the closed position the latch locks the lid in the closed position.

7. The tray according to claim 6, wherein the latch includes a projection that engages the skirt when the lid is in the closed position in order to lock the lid in the closed position.

8. The tray according to claim 7, wherein the latch includes a lever configured for a user to pull so as to unlock the lid from the closed position.

9. The tray according to claim 5, wherein:

the base includes two depressions in the rim and the skirt that define two handles for the tray, and one of the depressions is arranged at each end of the base.

10. The tray according to claim 1, wherein:

the ridges include an outer ridge and inner ridges, the outer ridge surrounds the inner ridges, the inner ridges are arranged in a grid, and the ridges divide the bottom of the lid into the holding areas.

11. The tray according to claim 10, wherein the ridges completely surround each of the holding areas.

12. The tray according to claim 11, wherein the inner ridges include:

straight ridges, circular ridges and triangular ridges, one of the circular ridges is arranged at each intersection of four of the straight ridges, and one of the triangular ridges is arranged at each intersection of one of the straight ridges with the outer ridge.

13. The tray according to claim 12, wherein the outer ridge, the circular ridges, and the triangular ridges all extend further from the bottom surface of the lid than the straight ridges.

14. The tray according to claim 1, wherein each of the holding areas is aligned directly below the respective one of the compartments.

15. The tray according to claim 14, wherein:

the compartments are separated from each other by walls, tops of the walls define lands and grooves, and the tops of the walls are below the rim and the open top.

16. The tray according to claim 1, wherein the holding areas are not as deep as the compartments.

17. The tray according to claim 16, wherein a depth of each of the compartments is 1.20-1.35 inches.

18. The tray according to claim 17, wherein a depth of each of the holding areas is 0.10-0.30 inches.

19. The tray according to claim 18, wherein a shape of each of the compartments and of each of the holding areas is a hollow parallelepiped with one open side.

* * * * *